United States Patent [19]

Arnold et al.

[11] 4,398,672

[45] Aug. 16, 1983

[54] ELECTROSTATIC SPRAYING

[75] Inventors: Arthur J. Arnold, Harpenden; Barry J. Pye, Luton, both of England

[73] Assignee: National Research Development Corporation, London, United Kingdom

[21] Appl. No.: 245,209

[22] Filed: Mar. 18, 1981

[30] Foreign Application Priority Data

Mar. 20, 1980 [GB] United Kingdom ..... 8009366

[51] Int. Cl.[3] ..... B05B 5/04

[52] U.S. Cl. ..... 239/701; 239/703

[58] Field of Search ..... 239/3, 7, 700–703, 239/224, 225

[56] References Cited

U.S. PATENT DOCUMENTS

| | | | |
|---|---|---|---|
| 2,989,241 | 6/1961 | Badger | 239/703 |
| 3,010,428 | 11/1961 | Sedlacsik | 239/703 X |
| 3,086,712 | 4/1963 | Frazier | 239/224 X |
| 3,221,992 | 12/1965 | Sedlacsik, Jr. et al. | 239/703 |
| 4,148,932 | 4/1979 | Tada et al. . | |

FOREIGN PATENT DOCUMENTS

| | | |
|---|---|---|
| 885597 | 12/1961 | United Kingdom . |
| 887450 | 1/1962 | United Kingdom . |
| 917683 | 2/1963 | United Kingdom . |
| 1012129 | 12/1965 | United Kingdom . |
| 1037936 | 8/1966 | United Kingdom . |
| 1107060 | 3/1968 | United Kingdom . |
| 1307878 | 2/1973 | United Kingdom . |
| 1311464 | 3/1973 | United Kingdom . |

OTHER PUBLICATIONS

A. J. Arnold and B. J. Pye, Spray Application with Charged Rotary Atomisers, British Crop Protection Council, 7 30, 1981, pp. 109–117., Monograph 24, May 1980.

*Primary Examiner*—Andres Kashnikow

*Attorney, Agent, or Firm*—Cushman, Darby & Cushman

[57] ABSTRACT

An electrostatic crop spraying apparatus is arranged so that spray is ejected from the nozzle directly towards the crop, either vertically downwards or at an angle intermediate between the horizontal and the vertical. With respect to the vertical, the spray liquid is fed to the upper surface of a rotatable disc from which it is centrifugally distributed on to the inner surface of a rotatable hollow cone coaxial with the disc. The truncated apex of the cone is uppermost and the liquid is atomized on ejection from the lower circumferential edge of the cone. Charging of the spray is produced at the surface of the disc or of the cone by means of an electrode which maintains an ionized air path to the surface over a distance of a few mm. The current flow for an electrode potential in the range 15 to 30kV is a few μA. A pump may be used to supply liquid to the nozzle in a pulsed flow.

15 Claims, 4 Drawing Figures

ELECTROSTATIC SPRAYING

The invention relates to apparatus for electrostatic spraying particularly for the application of electrostatically charged atomised liquids to growing crops.

It is now well-known that insecticides and other materials for application to the foliage of plants in a spray of liquid solution or suspension can be more effectively and economically used if the droplets are electrically charged. Because the moisture content of a growing plant causes the leaf surface to be effectively at earth potential the particular advantage arises that a charged droplet may as easily be attracted to the normally inaccessible undersurfaces of the leaves as to the upper surfaces.

In known forms of apparatus the spray is carried by an air-jet from a nozzle which is maintained at high voltage or is distributed from the edge of a rotating dish into which the liquid is poured. In the second case the liquid is spun outwards to form a thin layer over the upwardly inclined sides of the dish and is charged, for example, by a corona discharge from an electrode at a very high voltage, as atomisation occurs at the edge of the dish. The major component of velocity lies in the plane of the edge but inevitably an upwardly directed component is also present and must be taken into account in considering the eventual ground distribution of the spray. The air-jet sprayer can be aimed in any required direction but the rotating dish device must be held generally horizontal.

In accordance with the invention there is provided apparatus for the electrostatic spraying of liquid comprising inlet means for admitting a supply of liquid, a first rotatable member having a distribution surface disposed to receive the liquid for centrifugal distribution, a second rotatable member having an internal conical surface disposed to receive the liquid from the first member for centrifugal atomisation from a circumferential edge, the members having a common axis of rotation and the circumferential edge being disposed with respect to the first member in that axial direction which is remote from the distribution surface, and electrode means for conveying electric charge to a liquid layer at at least one of the distribution surface and the conical surface such that the spray of atomised particles from the circumferential edge is electrically charged.

Such disposition of the operative surfaces enables the axis of the nozzle to be directed downwards or at angles intermediate between the horizontal and the vertical.

Charge may be conveyed from the electrode means to the conductive surface of the liquid layer when the relevant one of the distribution surface and the conical surface is insulating but it is preferred that at least that one of the surfaces should be conductive.

Preferably the arrangement is such that the relevant surface is the distribution surface.

Preferably the edge of at least that one of the surfaces is sharply radiused such that when the liquid layer at that edge is at an elevated potential a strong electric field is formed in the region of the edge.

Preferably the electrode means includes at least one conductive element having a sharply radiused boundary directed towards and spaced apart by an air-gap from the relevant surface, whereby in operation the air-gap becomes conductive as a result of ionisation.

Alternatively the electrode means may include a trailing brush forming a direct connection between a high-voltage supply and the relevant surface.

The supply of liquid may form a continuous stream when it is derived from an electrically isolated reservoir or when the liquid is electrically sufficiently highly resistive, such as may be the case for an oil-based insecticide formulation, that the leakage current does not exceed a predetermined value.

The supply of liquid may be pressurised with particular advantage when the viscosity of the liquid is variable with temperature or when the spraying axis approaches the horizontal.

The pressurised supply may be delivered as a pulsed jet, such that a conductive liquid may be used without providing a continuous conductive path through the delivery tube in so doing.

The rotatable members may be arranged for a desired range of operating conditions such that in the event of failure of the high voltage charging supply the uncharged droplets will be of an increased diameter for which no significant degree of drifting will occur.

In arriving at the invention it has been appreciated that the directional distribution of a charged atomised spray can be advantageously improved and controlled if the atomising surface is not required to face upwards. In the conventional design for a centrifugally atomising sprayer with corona charging, as previously mentioned, a high voltage electrode is arranged adjacent the edge of a dish at which atomisation occurs. The electrode and associated supply connections cannot generally be kept completely dry but it is apparent that the problem would be much more difficult if it were attempted to invert the sprayer. Additionally, a completely different form of liquid delivery arrangement would be necessary.

The result now achieved is that an arrangement for charging at comparatively low voltage is combined with a liquid dispensing and distribution system which enables the spray to be directed within an angular range from vertically downwards to near horizontal.

Embodiments of the invention will now be described with reference to the accompanying drawings in which.

Figure 1:
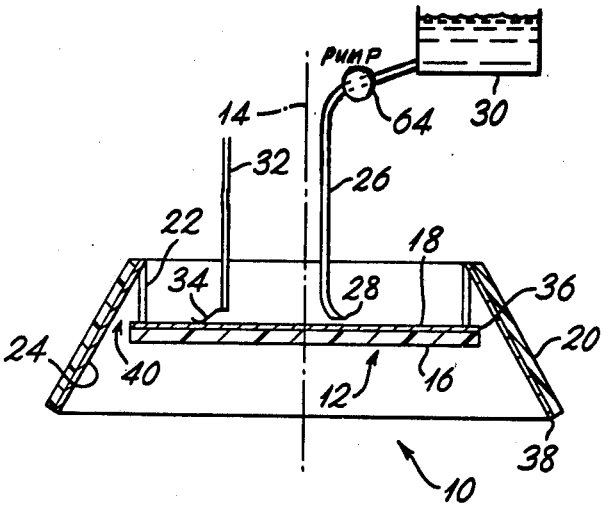
FIG. 1 illustrates the principle of construction of a nozzle in accordance with the invention.

With reference to FIG. 1 a nozzle 10 comprises a disc 12 which is rotatable about an axis 14 by means of a small battery powered electric motor (not shown). The disc 12 is of laminate construction, in the manner common in the preparation of printed circuit boards, having a rigid substrate 16 of insulating material and a thin upper surface layer 18 of copper. A thin-walled insulating body in the form of a truncated cone 20 having its apical end upwards is mounted symmetrically about spindle 14 by three insulating pins 22 set perpendicularly in surface 18 so that it rotates in balance with disc 12. The inner face of cone 20 is made electrically conductive and a coating 24 of a suitable suspension of flake silver is effective for this purpose. For clarity of illustration the thickness of the copper layer 18 and the coating 24 are shown greatly enlarged relative to their respective substrates. A delivery tube 26 is arranged with an outlet 28 close to the surface 18 to supply liquid at a slow and controlled rate from a reservoir 30 in which a constant head, so far as possible, is maintained above the outlet 28. A high voltage lead-in 32 terminates in a spring wire brush 34 which is maintained in contact with the copper layer 18 during rotation.

In a plant-spraying operation with a voltage in the range 15 kV to 30 kV applied to lead-in 32 and thence to layer 18, the nozzle may be 20–30 cm from the nearest point of the plant which is effectively at earth potential. The copper layer 18 is thin and the edge 36 is necessarily sharp so that a strong electric field will exist at the edge 36. The lower periphery 38 of the conductive coating 24 on the cone 20 is also presented to earth as a sharp edge and consequently if the annular gap 40 between edge 36 and the inner surface of cone 20 is made small a conductive path from edge 36 to earth is set up through the air-gap 40, coating 24 and the air-path below cone 20 to the plant. As a result the potential of coating 24 becomes similar to the supply value, the current being only a fraction of 1 $\mu$A for dry air. When liquid is delivered to the surface 18 with disc 12 rotating, a liquid film is spun out to edge 36 where it breaks up, the droplets becoming charged. The behaviour of droplets on surface 24 is uncertain but it seems likely that under increasing radial acceleration many droplets will remain discrete until at the edge 38 they are further divided and are dispersed with an enhanced charge. The general mechanism is believed to be similar for liquids of high and low resistivities but in the latter case the discharge current rises to a few $\mu$A. The increase in current may be attributable to the readier acceptance of charge by a conductive material and may also partly arise from an increase in conductivity in the mist-filled air-path to earth. It should be noted, however, that there is at no time any visible discharge in the air-gaps and such low-current ionisation is to be contrasted with the conventional corona discharge method of charging in which the current drawn is typically many tens of $\mu$A.

Figure 2:
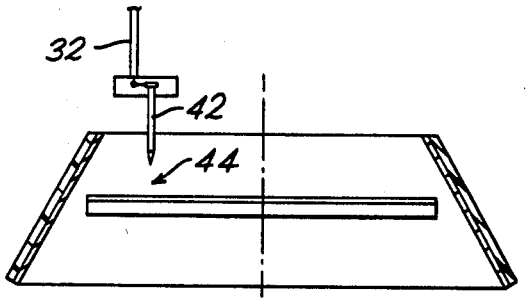
FIG. 2 illustrates a modified electrode for substitution in FIG. 1.

FIG. 2 shows in part a modified form of the device of FIG. 1 in which contact brush 34 is replaced by a needle electrode 42 mounted normally to the disc 12 with the point spaced apart from the layer 18 by an air-gap 44. Operation of the device is as described for FIG. 1 except that the conductive path to earth from the high voltage supply now includes the additional short air-gap 44 of a few mm. The advantage results, however, that the mechanical contact of brush 34, which causes wear and requires maintenance, is replaced by the ionised air column occupying the gap 44. The width of gap 44 is not critical within a range from 1 mm to at least 5 mm for an applied voltage up to 30 kV, the range from 1 mm to 3 mm being preferred.

Figure 3:
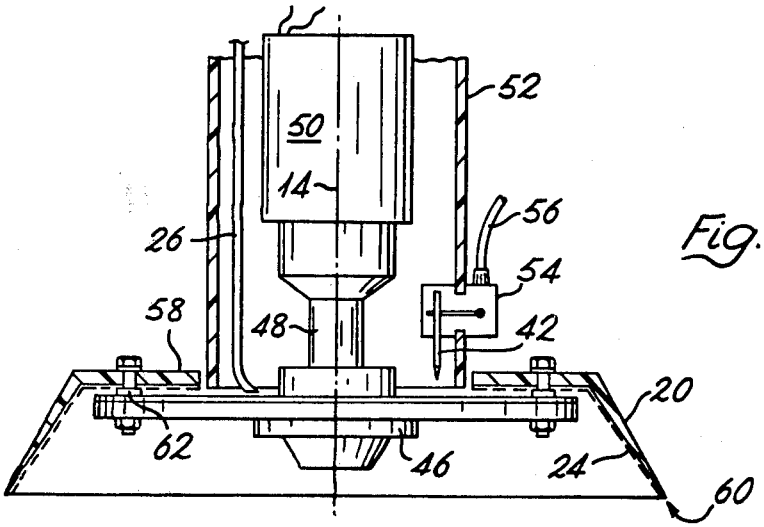
FIG. 3 shows diagrammatically a device incorporating the electrode of FIG. 2.

A further improved form of the device retaining the needle electrode 42 is shown in FIG. 3. Disc 12 has an insulating brush 46 to receive an insulating extension spindle 48 from a small battery driven motor 50 and the whole drive unit is housed in an insulating tube 52 which extends to within 1 or 2 mm of the surface 18 of the disc 12. Liquid delivery tube 26 is housed within tube 52 close to the wall and in a diametrically opposite position needle 42 is suspended from a mounting 54 which passes through the wall of tube 52 for connection to a high voltage cable 56. The cone 20 is now truncated only slightly above the level 18 and is fitted with an annular cap 58. The internal diameter of cap 58 is large enough to provide satisfactory clearance from tube 52 during rotation but almost the whole surface of layer 18 is now shielded. The silver coating 24 on the inner face of cone 20 is extended over the underside of cap 58. The wall of cone 20 is indicated as tapering in thickness to provide a sharp edge 60 which may be finely serrated to provide localised regions of increased field to enhance the final charge carried by the spray. The axial spacing between cap 58 and surface 18 is conveniently made small (in the order of 1 mm) but the spacing is not critical although it is desirable that the rotating assembly should be as compact as possible for reasons of mechanical stability. It is then difficult to provide an insulating attachment between cone 20 and disc 12, such as was indicated in FIG. 1 by pins 22. It is found to be a satisfactory solution to use conducting screws and spacers 62 between cap 58 and disc 12. Charging is thought to occur then only at edge 60; alternatively if the conducting coating 24 is omitted from cone 20 and cap 58 charging could be expected to occur only at edge 36 for a liquid of low conductivity. In the absence of the metallic coating 24 it is likely that a conductive liquid would fulfil the same function and that charging would again occur only at edge 60.

It is generally desirable that the nozzle should present externally insulating surfaces to the operator but the rotatable disc 12 and cone 20 can be made wholly metallic with suitable external protection. In the embodiments described the disc and cone are made from insulating material with a coating or surface layer 18 of copper and a coating 24 of silver, respectively. Such coatings are specified by way of example and the surfaces are satisfactorily rendered conductive by any suitable metallic or other material. It has been suggested above that a liquid of suitable conductivity will itself provide such a conductive surface so that in such a case the metallic coating 24 could be omitted from cone 20. It is further found that the metallic coating 18 can be omitted from disc 12 for conductive liquids, so allowing the rotary structure to be made from wholly insulating material.

With reference to FIGS. 1 to 3 electrode systems have been described which are effective to convey charge to the liquid layer which is formed on the upper surface of disc 12. Charging of the layer to substantially the level of the electrode potential occurs in dependence on the conductivity of one or both of the surface itself and of the liquid layer. Similar electrode arrangements may of course be used alternatively or additionally to convey charge directly to the liquid layer as it forms on the internal conical surface of the member 20. For example cone 20 or the cap 58 can be formed to present a conductive surface facing radially inwards towards electrode 34 or electrode 42. Less conveniently an electrode extended axially below disc 12 would be arranged to convey charge to the liquid layer on the conical surface when that surface was insulating. The most general requirement as to surface conductivity then becomes that at least in operation the wetted surface of disc 12 or of cone 20 should be conductive. It is clearly to be expected that the conductivity of water-based spray liquid is sufficient to satisfy that requirement but it is also found that oil-based formulations may provide adequate conductivity for the generation of a useful degree of charging. A spray formulation of higher resistivity will accumulate a greater charge when distributed over a surface of disc 12 of inherent conductivity, but each of the inherently insulating and the inherently conductive surfaces has a range of usefulness which is readily determined experimentally for specific liquids. The range of acceptable resistivity covers several orders of magnitude with reference to the resistivity of water-based material, but cannot usefully be made specific because charging is time dependent and the liquid flow-rate must be taken into account.

The liquid supply is shown in FIG. 1 to be delivered at a low pressure dependent on the position of reservoir 30. A spray material having an oil base may, however, vary in viscosity sufficiently with temperature to produce significant variations in the rate of flow. In a preferred arrangement therefore the liquid supply is maintained at a constant rate by means of a pump 64 which can be inserted in delivery tube 26.

A pump supply also provides the means to avoid excessive leakage of current from surface 18 through the delivery pipe to an earthed reservoir when the liquid is conductive. A peristaltic pump for example may have an associated air inlet such that a pulsed succession of liquid drops or larger units can be delivered which are electrically isolated from each other by interspersed pockets of air. In a tube of material such as a silicone rubber, wetting of the walls is slight and isolation can be substantially complete.

When only a small volume of liquid is to be carried, the reservoir can be electrically isolated and no risk will result if it is allowed to charge to a high voltage. A larger reservoir will normally be earthed and, unless pulsed pumping or other isolating technique is applied, the liquid must then have sufficient resistivity to limit the leakage current to a predetermined level. This level should not be excessive in relation to the charging current if the power supply is to be of economic size.

The use of a pumped supply also extends the operation of the nozzle to positions in which the axis is not vertical. The centrifugal operation of the two liquid distribution surfaces enables a stable spray pattern to be maintained over a wide range of orientation, but the initial delivery of liquid to surface 18 creates an obvious difficulty. This difficulty is overcome by pumping liquid to surface 18 at a constant rate which provides effective control at the very low rates of consumption, typically of 30 mL/mins, which are required. The ability to spray on a range of axes between the vertical and the horizontal is useful for plants whose foliage is not penetrated by an overhead spray.

It is envisaged that in large-scale field use, oil-based formulations may be preferred because of the widely variable rate of evaporation of water droplets in different atmospheric conditions. For use in greenhouses and in horticultural applications generally a water-based spray may be preferred and a hand-held version of a sprayer according to the present invention would be suitable for such requirements. In a still-air operation of that kind, a charging voltage as low as 10 kV may be quite adequate.

Laboratory tests on plant material have shown an increase in deposition of at least four times for the sprayer of FIG. 3 operated in the charging condition as compared with the uncharged spray. The distribution of droplets over the plant surfaces also shows the improvement to be expected with electrostatic charging, particularly the deposition of the spray on the plant stems and the underside of the leaves. It is an important consideration in field spraying that drift of sprayed material should be controlled and the present device provides such control in normal operation and also in the event electrical failure. The charged spray, for a particular oil-based material, has a characteristic drop diameter of 50 μm with very small dispersion. The associated electric field to earth is effective to control the deposition area for droplets of that size. If the high-voltage supply should fail for any reason spraying can continue but with less efficiency since the droplet size is then increased to 200 μm. Again, however, the dispersion of drop size is low and deposition is localised so that drifting is slight. The conical member 20 can be designed to ensure this result on the basis of accumulated experience with readily available centrifugal non-electrostatic sprayers.

Figure 4:
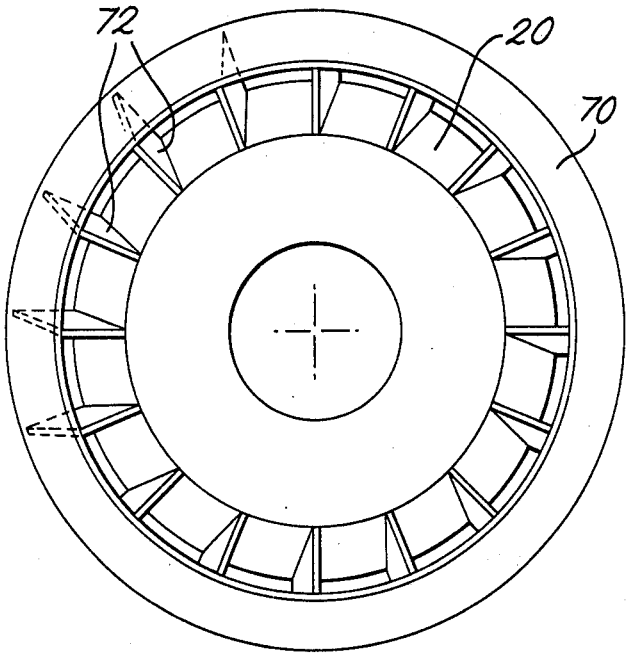
FIG. 4 shows diagrammatically a modification of a component of the device of FIG. 3.

A further means of deposition-control is indicated in FIG. 4 which shows a modified form of the rotary conical body 20 suitable for use in the nozzle of FIG. 3. A cone 70 of similar height to cone 20 but of larger diameter is arranged to lie on the same axis. The walls of cones 20 and 70 are joined within the annular space between them by generally radial ribs 72 which are disposed to serve as impeller blades. On rotation of the conical structure a flow of air is thus produced in the direction of spraying which has the effect of limiting the outward dispersal of the spray from the edge of cone 20. Entrainment of spray in the air flow also results in an increased penetration of foilage and in this way the advantages both of electrostatic charging and of air-driven spraying can be obtained. The device shown in FIG. 4 is particularly suitable for a hand-held sprayer which is dependent on the use of a compact and light-weight power source. In field use, where machine power is available, air under pressure can readily be provided to be directed through a channel such as the annular space between cones 20 and 70. Simple ribbed supports between the cones are then structurally adequate, the impeller action of blades 72 being unnecessary. It will be appreciated that full control of deposition in any specific application requires experiment to establish the appropriate balance of interrelated relevant parameters, particularly the rate of liquid flow, voltage, charge, drop size and air flow (if that facility is used).

The power supply for a single spray head generally need not exceed an output of 30 kV at 10 μA (and the load will generally be considerably below this rating) and can be provided compactly and at relatively low cost. The conductors and connections present no unusual problems of insulation of such voltages.

We claim:

1. An apparatus for the electrostatic spraying of liquid, the apparatus comprising:

inlet means for admitting a supply of liquid;

a first rotatable member having a distribution surface, said surface being disposed to receive the liquid from the inlet means for centrifugal distribution;

a second rotatable member having an internal conical surface, said conical surface being disposed coaxially with said distribution surface to receive the liquid from said distribution surface for centrifugal atomisation from a circumferential edge of said conical surface, and said circumferential edge being disposed with respect to said first member in that axial direction which is remote from said distribution surface;

means to support the first and second members in a spaced relationship to form a gap across which the centrifugal distribution occurs.

a terminal for the supply of electrostatic energy to an electrode means:

a said electrode means for conveying charge to a liquid layer at at least one of said distribution surface and said conical surface such that the spray of atomised particles from said circumferential edge is electrically charged;

an electrostatic feed path through the apparatus from said terminal to said electrode and onward to said circumferential edge including an air gap to electrically separate said edge from said terminal.

2. Apparatus according to claim 1 in which that surface at which charge is conveyed to the liquid layer from the electrode means is conductive.

3. Apparatus according to claim 1 in which the distribution surface and the conical surface are conductive.

4. Apparatus according to claim 1 in which that surface at which charge is conveyed to the liquid layer from the electrode means has a sharp edge.

5. Apparatus according to claim 1 in which each of the distribution surface and the conical surface has a sharp edge.

6. Apparatus according to claim 1, 2, 3, 4 or 5 in which the electrode means comprises a trailing brush forming a direct connection to the relevant surface.

7. Apparatus according to claim 1, 2, 3, 4 or 5 in which the electrode means comprises at least one conductive element having a sharply radiused boundary directed towards and spaced apart by said air-gap from the relevant surface, whereby in operation the air-gap becomes conductive as a result of ionisation.

8. Apparatus according to claim 7 in which the conductive element comprises a needle the point of which is directed normally to the relevant surface.

9. Apparatus according to claim 8 in which the relevant surface comprises the distribution surface, such surface being substantially planar.

10. Apparatus according to claim 9 in which the needle is enclosed by an insulating wall which extends to within a short distance of the distribution surface.

11. Apparatus according to claim 1 further including pumping means for delivering the liquid to the inlet means.

12. Apparatus according to claim 11 in which the pumping means is operative to deliver the liquid in a succession of units which are substantially electrically isolated from each other.

13. Apparatus according to claim 1 including means for directing a flow of air substantially parallel to the conical surface in the region of the circumferential edge which is effective to prevent lateral dispersal of the spray.

14. Apparatus according to claim 13 in which the means for directing a flow of air comprises a housing for air impeller means carried by the second rotatable member externally of the conical surface.

15. Apparatus according to claim 1 including means to electrically isolate the first member from the second member.

* * * * *